US008759759B2

(12) United States Patent
Ding et al.

(10) Patent No.: US 8,759,759 B2
(45) Date of Patent: Jun. 24, 2014

(54) LINEAR ION TRAP ANALYZER

(75) Inventors: Li Ding, Shanghai (CN); Tao Lin, Shanghai (CN); Gongyu Jiang, Shanghai (CN); Hui Mu, Shanghai (CN)

(73) Assignee: Shimadzu Corporation, Kyoto (JP)

( * ) Notice: Subject to any disclaimer, the term of this patent is extended or adjusted under 35 U.S.C. 154(b) by 76 days.

(21) Appl. No.: 13/079,740

(22) Filed: Apr. 4, 2011

(65) Prior Publication Data

US 2012/0248307 A1 Oct. 4, 2012

(51) Int. Cl.
*H01J 49/00* (2006.01)

(52) U.S. Cl.
USPC ..... 250/292; 250/281; 250/282; 250/288; 250/290

(58) Field of Classification Search
USPC ..... 250/281, 282, 283, 286, 288, 290, 292
See application file for complete search history.

(56) References Cited

U.S. PATENT DOCUMENTS

| | | | | |
|---|---|---|---|---|
| 5,468,958 | A | 11/1995 | Franzen et al. | |
| 6,087,658 | A | 7/2000 | Kawato | |
| 6,608,303 | B2 | 8/2003 | Amy et al. | |
| 6,909,089 | B2 * | 6/2005 | Londry et al. | 250/282 |
| 6,911,651 | B2 | 6/2005 | Senko et al. | |
| 7,279,681 | B2 | 10/2007 | Li et al. | |
| 7,285,773 | B2 | 10/2007 | Ding et al. | |
| 2009/0127456 | A1 * | 5/2009 | Makarov et al. | 250/290 |

FOREIGN PATENT DOCUMENTS

| | | | |
|---|---|---|---|
| CN | 1585081 | A | 2/2005 |
| CN | 1925102 | A | 3/2007 |

* cited by examiner

*Primary Examiner* — Nicole Ippolito
*Assistant Examiner* — Hanway Chang
(74) *Attorney, Agent, or Firm* — Kilpatrick Townsend & Stockton LLP

(57) ABSTRACT

The present invention relates generally to the field of ion storage and analysis, in particular to a linear ion trap mass analyzer comprised by multiple columnar electrodes. High frequency voltages are applied on at least one of the columnar electrodes to form ion confining space, which mainly consists of two-dimensional quadrupole electric radial trapping field, and there is at least one through slot for ion ejection in at least one direction perpendicular to the axis of the ion trap, wherein an AC electric field superposition is applied to invoke dipole excitation. Opposite to the through slot, there is an elongated electrode for field adjusting between two columnar electrodes or inside the slit of one of the columnar electrodes mentioned above. The potential on the elongated electrode for field adjusting is set as the sum of a portion of the high frequency voltage which applied on one adjacent columnar electrode and a DC offset, which can be adjusted freely. Through adjusting the portion of the high frequency potential and DC potential on this electrode, one or more objectives, including field optimization inside the ion trap as well as ion motion characteristics of resonant ejection, can be realized.

17 Claims, 8 Drawing Sheets

LINEAR ION TRAP ANALYZER

FIELD OF INVENTION

This invention relates to ion mass analytical technology using ion trap, and more particularly relates to a linear ion trap analyzer with electric field optimization.

BACKGROUND

The technology for traditional quadrupole ion trap was greatly developed after its invention in the 1950's, and was applied in a wide variety of mass spectrometer instrument system. Many articles and patents related to this field were collected in the book "Practical Aspects of Ion Trap Mass Spectrometry" written by R. E. March and J. F. J. Todd. Usually, the three-dimensional ion trap (3D-IT) with rotary symmetry comprises a trapping volume for mass analyzing surrounded by a ring electrode and an opposing pair of end-cap electrodes. RF voltage is applied on the ring electrode to form a substantial quadrupole field to confine the ions, and a dipole AC voltage is applied between the opposing pair of end-caps to excite the ions motion and ejected out mass-selectively, to achieve mass scan of the ion trap.

The two-dimensional linear ion trap (2D-LIT) mass spectrometry instruments have been widely used because of their high sensitivity and storage capacity after commercialization. There are many designs for 2D-LIT. Commonly, as shown in FIG. 1, the 2D-LIT comprises two pairs of main electrodes 1 and 2 placed in X and Y directions perpendicular to each other, which are applied with a pair of opposite phased high frequency driving voltages separately, to form a two-dimensional linear quadrupole radial trapping electric field. Through the method of separating X and Y electrodes 1 and 2 into three segments (front 3, middle 4 and rear 5) or setting a pair of front and rear end-caps, another DC or AC axial trapping field along the trap axis (Z direction) can be formed. Usually, the ions are injected from one end along the Z axis into the ion trap and are confined in the linear shaped volume between the X and Y electrode pairs. If an additional dipole excitation voltage is applied between the X pairs of electrodes, the confined ions can be resonantly excited according to their mass-to-charge ratios and ejected out through the outlet slits 3 on X pairs of electrodes to realize mass-scan function when the amplitude or the frequency of the driven voltage is scanned.

Over years, many scientists made effort on improving the performance of ion trap in mass scan through optimizing the trapping field. For example, to overcome the effects of negative fringe field around the ejection hole during resonant ejection in 3D-IT, Kawato et al. introduced embossment flanges on the round edge of the ejection hole in U.S. Pat. No. 6,087,658. For the same problem, in U.S. Pat. No. 6,911,651, Senko et al. stretched the distance between the end-caps and made concentric recess around the outlet hole.

Above all, field improvement in ion trap by amendment on electrodes highly depends on the mechanical accuracy. Once the modified electrode is formed, the amendment of field is fixed and optimized for certain analytical condition. If the working cycle of ion trap contains more than one stage and needs different field optimization conditions, these methods may not be useful.

The designer produces a kind of 3D-IT with more than one circular electrodes in U.S. Pat. No. 5,468,958. These electrodes are applied with RF voltage of different ratios. The electric field can be adjusted by changing the ratios. An amended electrode is embedded in the end-cap electrode to introduce a field component which can be adjusted by voltages to optimize trapping field in a small range (in U.S. Pat. No. 7,279,681, L I Gangqiang et al). While in U.S. Pat. No. 6,608,303 by Amy et al., a thin metal electrode on which a RF potential with particular phase was applied, was embedded in the ejection hole to optimize field around.

The design and accuracy are simplified. The field inside can be adjusted through outside. and these technologies are used on linear ion trap gradually. In CN1585081, Chuanfan Ding designed a kind of linear ion trap surrounded by printed circuit boards. As using a lot of individual adjustable electrodes, flexible field adjustment, as well as larger ion capacity and lower cost are achieved.

But in all the above technologies, all the electrodes invoked to correct electric field depend on high frequency power supply which can accurately control voltages that are applied on these electrodes. This high frequency power supply could be a usual RF-resonant high frequency power supply or alternatively a high frequency switch power supply used by digital ion trap. Anyway, the instruments become complicated with the additional power supply.

A field adjusting electrode is placed behind the injection hole of one end cap in 3D ion trap and is driven by a DC voltage to affect respectively ion motions during injection and ejection in U.S. Pat. No. 7,285,773 by Dingli. Although this kind of local corresponding correction hasn't fully improved high frequency field components, yet as for ions which are excited, motion characteristics have been greatly improved. Since field adjusting electrode only needs to apply with a DC voltage rather than a high frequency voltage, instruments could be simplified and adjustment could be easy. But this patent is not for linear ion trap shown in FIG. 1. For linear ion trap, an ejection hole is usually made in a pair of electrodes (for example, in X direction). To ensure zero potential along axis, the pair of electrodes are applied with RF voltages or high frequency switch voltages of opposite phase with the ones applied on another pair of electrodes (in Y direction). Since there is no such zero position as in AC potential applied on end-caps in 3D ion trap, it has difficulties setting field adjusting electrode and applying voltages.

Besides, ions could eject from the two through slots on X electrodes after resonant excitation in linear ion trap, so two detectors need to place behind X electrodes to obtain maximum signal which may increase cost.

SUMMARY

One of the purposes of this invention is to design a proper field adjusting electrode and its corresponding power supply, optimize the electric field inside the linear ion trap and ions motion characteristics as well as ions ejection from one through slot as many as possible.

An aspect of the invention provides a linear ion trap analyzer, comprising a ion trapping volume multiple surrounded by columnar electrodes, whereas, the generatrix of said columnar electrodes are parallel to the central axis of the trapping volume, at least a part of said columnar electrodes is applied with high frequency voltage to form in said trapping volume the trapping electric field which is dominated by two dimensional quadrupole field. At least one through slot for ion ejection orientated in one direction perpendicular to the said axis, wherein AC electric field superposition is applied to invoke dipole excitation in said one direction; In this invention, an elongated field adjusting electrode is set inside the slot on one columnar electrode opposite to the through slot or between the two columnar electrodes, wherein the potential on the field adjusting electrode is set as the sum of a portion of the high frequency voltage applied to one adjacent columnar electrode and a DC voltage offset, which is adjustable. Through adjusting the geometry or the location of the elongated electrode or the potential on it, one or more objectives, including field optimization inside the ion trap as well as ion motion characteristics of resonant ejection, can be realized.

According to one embodiment, a linear ion trap analyzer mentioned above may further include an electric circuit for applying voltages on the said field adjusting electrode comprising a capacitor for coupling the high frequency voltage to the said field adjusting electrode from the said adjacent columnar electrode, and a resistor and/or an inductor for applying a DC voltage superposition on the said high frequency voltage, and the DC voltage is controlled by a DC voltage source.

According to one embodiment, a linear ion trap analyzer mentioned above may further include an electric circuit for applying voltages to the said field adjusting electrode comprising a capacitor for coupling the high frequency voltage to the said field adjusting electrode from the said adjacent columnar electrode, and the diodes for applying a DC voltage superposition on said high frequency voltage, wherein the DC voltage controlled by a DC voltage power supply and the DC amplitude of the said power supply substantially equals to the sum of the required DC voltage offset of field adjusting electrode and the positive or negative peak value of the said high frequency voltage.

According to one embodiment, at least part of the columnar surface of the said columnar electrodes is hyperbolic columnar surface.

According to one embodiment, at least part of the columnar surface of the said columnar electrodes is planar columnar surface.

According to one embodiment, at least part of the columnar surface of the said columnar electrodes is step shaped columnar surface.

According to one embodiment, at least part of the columnar surface of the said columnar electrodes includes the planar patterns of printed circuits on the surface.

According to one embodiment, the said field adjusting electrodes comprise of single or multiple sections of segmented electrodes According to one embodiment, the said high frequency voltages are generated by digital switches and in rectangular waveforms.

According to one embodiment, the strength or the frequency of the trapping electric field is scanned while the said AC electric field superposition is applied to invoke dipole excitation in the direction perpendicular to the said axis and to invoke the ions trapped inside the linear ion trap to eject out resonantly according to their mass-to-charge ratios; and also includes controlling means to alter the DC voltage applied on the said field adjusting electrode when the said scan is reversed or the scan speed is changed.

According to one embodiment, the said value of DC voltage applied on the said field adjusting electrode is adjusted to improve the ejection efficiency through the outlet slot opposite to the field adjusting electrode during the scan where ions eject out resonantly according to their mass-to-charge ratios.

According to one embodiment, the value of DC voltage applied on the said field adjusting electrode is set to generate a DC high order field during the said AC electric field is applied to invoke dipole excitation of at least one ion, wherein the DC high order field alters the secular frequency of the said at least one ion from the frequency of the said AC electric field and break their resonance when the amplitude of the ion motion is close to the field radius of the linear ion trap, so that the ion avoid being further excited.

The electrode field can be adjusted according to the need of real working mode through field adjusting electrode in linear ion trap. It has a great influence on ion kinetic character while resonance ejection. And part of positive ions which could eject from left side could be reflected by field adjusting electrode as long as the DC voltage is high enough applied on field adjusting electrode. Thus more ions eject from the outlet slot of right X electrode to increase the outlet efficiency of single side.

BRIEF DESCRIPTION OF DRAWINGS

To make the purposes, characteristics and advantages mentioned above in this invention more obvious and easier to understand, the following is the embodiments of this invention combined with figures demonstrated in detail, including.

DETAILED DESCRIPTION OF EMBODIMENTS

The linear ion trap related should be demonstrated before further description to this invention.

A linear ion trap was usually described as space either surrounded by a set of poles or defined by several electrodes extended along axial direction. In order to involve the substance of linear ion trap, columnar electrodes are used in stead of poles or electrodes extended along axis. The so called columnar surface is defined as such curved surface formed by straight lines parallel to a fixed line (here defined as Z axis) and moving along a directrix. These moving straight lines are called generatrix of columnar surface. Multiple columnar electrodes, the linear ion trap formation, are not necessarily columns but have columnar surface and their generatrix are parallel to each other as well as a central axis (z axis), which is coupled clearly with the statement of electrodes extending along the axial direction. Also, the columnar surfaces are not necessarily very long, so the linear ion trap is not necessarily elongated. Moreover, planar is also involved as a special case (That is, directrix is a straight line or a polyline.). In other words, for several planar electrode surfaces, as long as they are placed parallel to z axis, and space surrounded by those surfaces can be formed to trap ions under proper situation, are also involved in the discussion about the electrode geometry in this invention.

Embodiment I

Figure 1:
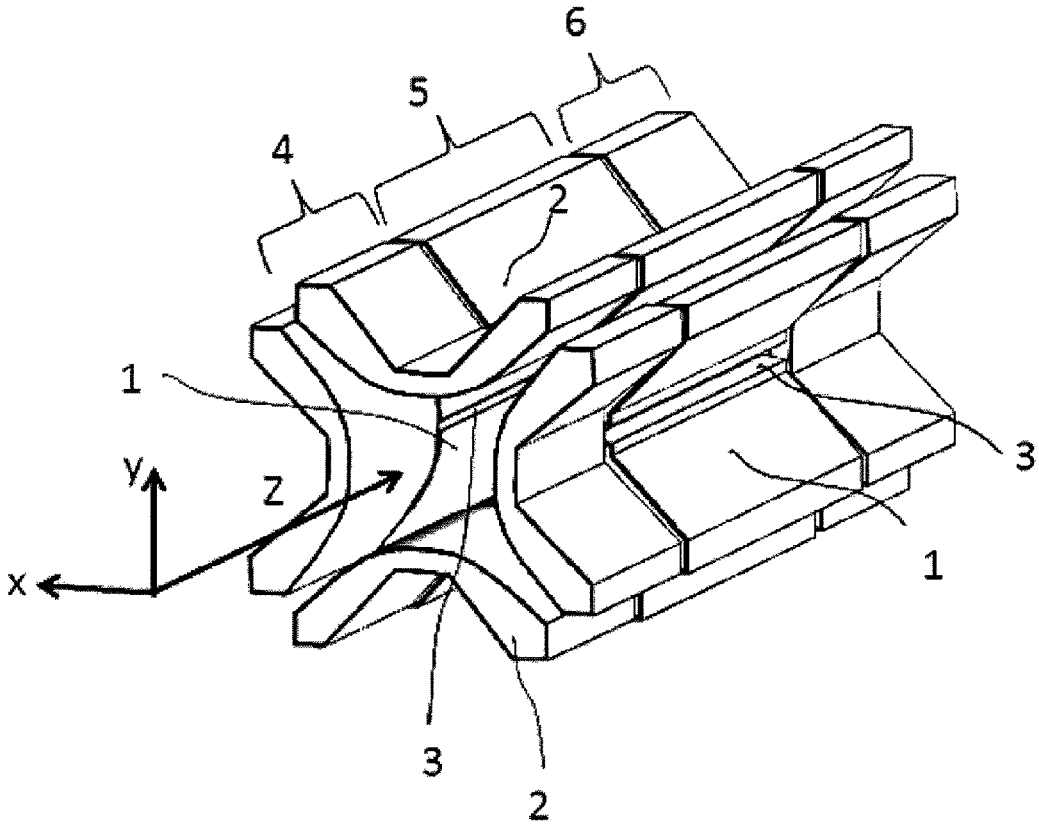
FIG. 1 shows the basic structure of linear ion trap which may eject ions from radial direction.
Figure 2:
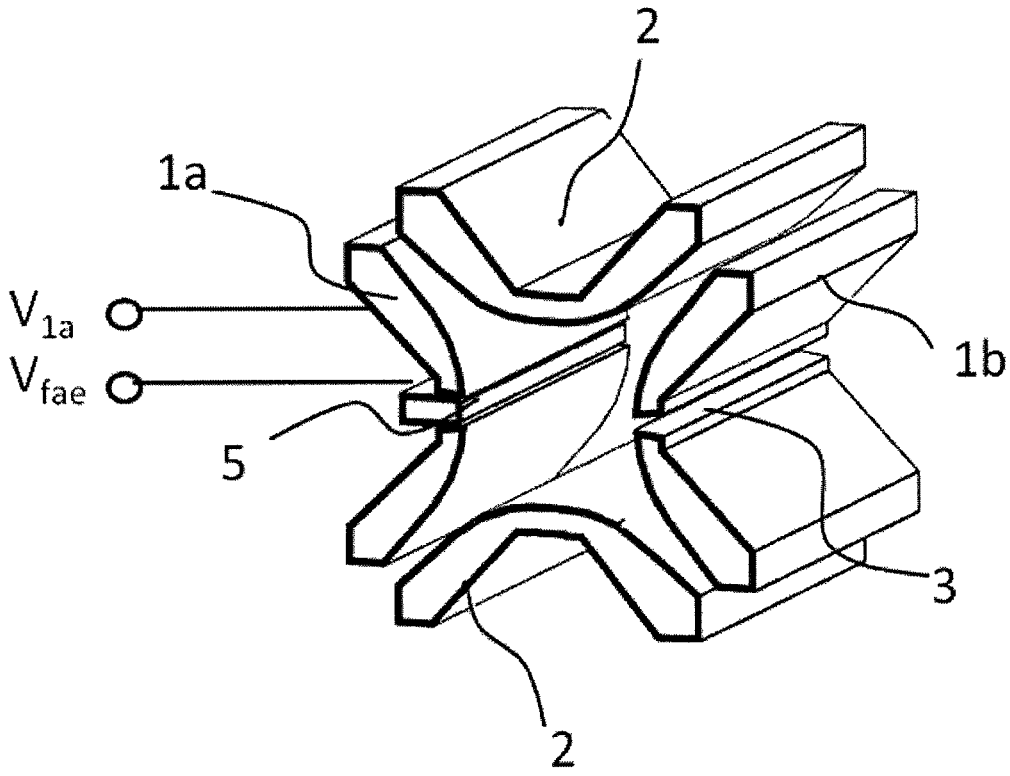
FIG. 2 shows part of the structure of the linear ion trap according to the first embodiment, wherein field adjusting electrode has been set in the columnar X electrode.

Again, FIG. 1 is used to demonstrate one of the embodiments. Two-dimensional linear ion trap is divided, in structure, into front segment 4, middle segment 5 and post segment 6, among which 4 and 6 are applied with higher potential to trap ions in axial direction (for positive ions, as for negative ions they should be lower potential, the same hereinafter). Each said segment has two pairs of main electrodes 1, 2 in X and Y directions, respectively, on which high frequency driving voltages with opposite phases are applied, to form radial trapping field. In an alternative embodiment, front segment 4 and post segment 6 can be also replaced by front and post end-caps, in order to form a DC or AC trapping field. Ions are usually injected in z direction from one end of linear trap, and trapped in the elongated volume between the said two pairs of electrodes in X and Y directions. If a dipole excitation voltage is superimposed in X direction of ion trap, ions will be resonantly excited and selected according to their masses, and ejected through the slot 3 in X electrode and detected by the detector which is located outside X electrode, so that mass scan can be realized. Alternatively, mass selection is firstly accomplished inside the ion trap, removing unnecessary ions and then eject the rest ions altogether to the detector or to the next analytical space (eg. the second ion trap or time-of-flight analyzer, etc). FIG. 2 only shows the middle segment 4 of the said two-dimensional linear ion trap. In order to form good quadrupole electric field for the resonant ejection, avoiding delay ejection caused by mismatch of ion frequency and excitation frequency, the two pairs of columnar electrodes in X and Y directions are generally fabricated to be hyperbolic-columnar surfaces or others close to hyperbolic columnar surfaces. Sometimes in order to remove adverse effects caused by negative high order field around ejection slot 3, standard hyperbolic surfaces are somehow stretched along X direction.

In this embodiment, an elongated field adjusting electrode 5 is placed in the middle of X electrode 1*a* oppositely faced to the ejection slot. Voltage on this electrode is set to the sum of at least a portion of the high frequency voltage V1*a* applied to on nearby X electrode 1*a* and a DC voltage VDC, that is:

$$V_{fae}=cV_{1a}V_{DC}0<c\leq 1$$

in which, the high frequency voltage $V_{1a}$ includes the original high frequency quadrupole driving voltage and the dipole excitation AC voltage. Before resonant ejection, the amplitude of ions motion gradually becomes larger and larger and negative high order field will reduce secular frequency when ions move close to the ejection slot. For example, positive ion will oscillate near to the field adjusting electrode 5 when the high frequency quadrupole voltages on X electrode 1*a* and 1*b* turn positive. If $V_{DC}$ is made positive, positive ions will obtain extra reversing force, so that secular frequency reduction can be avoided. This helps ion ejection quickly.

Moreover, when $V_{DC}$ is properly adjusted, the positive voltage can make more positive ions eject from columnar electrode 1*b*, increasing single-side ejection efficiency of ions. This will save a detector, comparing with both-side ejection.

Embodiment II

Figure 3:
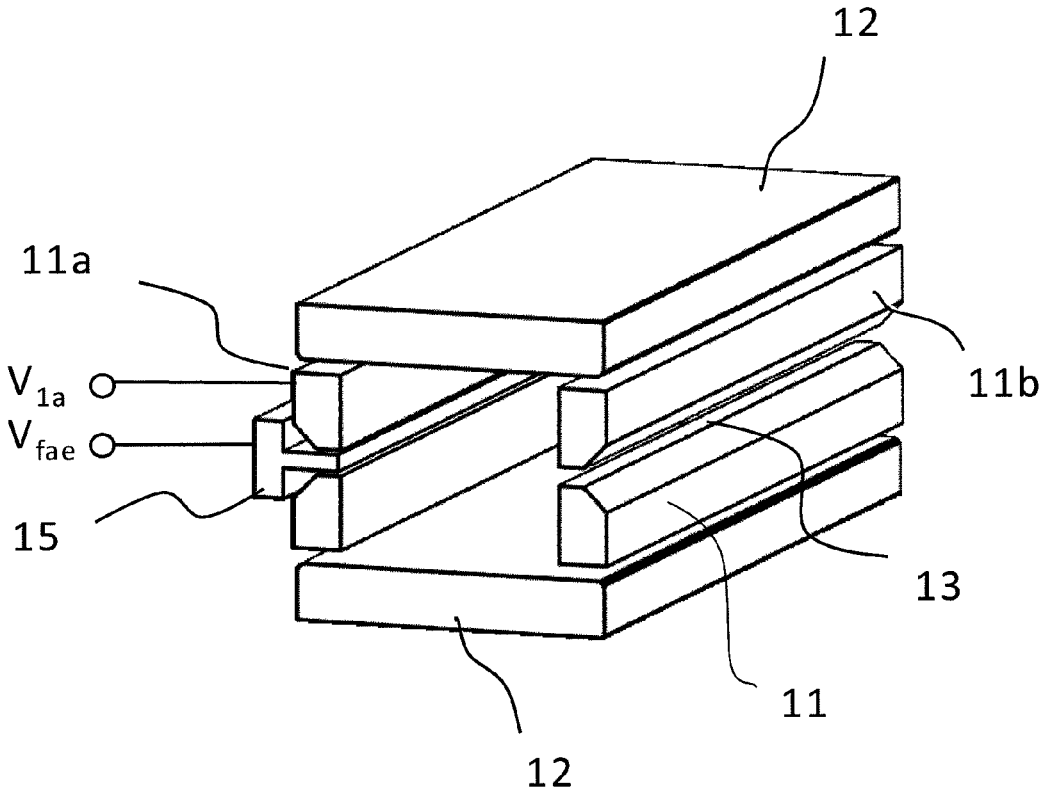
FIG. 3 shows part of the structure of the linear ion trap with planar electrodes according to the second embodiment.

As mentioned above, planar electrodes, as a special case of columnar electrodes, can also be used to comprise linear ion trap. FIG. 3 shows the schematic diagram of rectangular linear ion trap constructed by four planar electrodes according to the second embodiment. To make it clear and simple, FIG. 3 only shows the middle segment of the linear ion trap with front and post segment or end-caps omitted. Two pairs of main electrodes in X and Y direction (11 and 12) are respectively applied with high frequency driving voltages of opposite phases to form radial trapping electric field, which has been shown in FIG. 3. A field adjusting electrode 15 is set in the middle of X electrode 11*a* which is placed opposite to the outlet slot 13. Similarly with the first embodiment, the voltage applied on the field adjusting electrode is equivalent to composition of at least part of high frequency voltage V1*a* on adjacent X electrode 1*a* and a DC voltage VDC, that is:

$$V_{fae}=cV_{1a}+V_{DC}0<c\leq 1$$

It should be pointed out that the back shape of the field adjusting electrode 15 (apart from trapped ions) was designed just to make the mechanical assembling easy. This embodiment does not limit its specific shape.

Every columnar electrode contains only one planar surface parallel to axis in this embodiment and the electric field is quite different from two-dimensional quadrupole electric field, which may not be ideal enough to influence ions motion characteristics only through the field adjusting electrode adjustment. If multiple planar surfaces are used to form step shaped columnar surfaces or ones whose generatrix is polyline, a more similar electric field will be formed as that formed by hyperbolic columnar surfaces. This kind of design has been opened in CN1925102A. A field adjusting electrode can also be set in the middle of the electrode opposite to an outlet slot in this ion trap and be applied with voltage equivalent to composition of at least part of high frequency voltage and a DC voltage.

Embodiment III

In this embodiment, in order to obtain a good quadrupole electric field inside the rectangular linear ion trap built by planar electrodes, each electrode surface can be composed of several sub-electrodes, on which high frequency voltage with certain proportion is applied separately to form a similar electric field with that formed by hyperbolic columnar electrodes. The details of these ion traps can be found in Chinese publication No. CN1585081.

Figure 4:
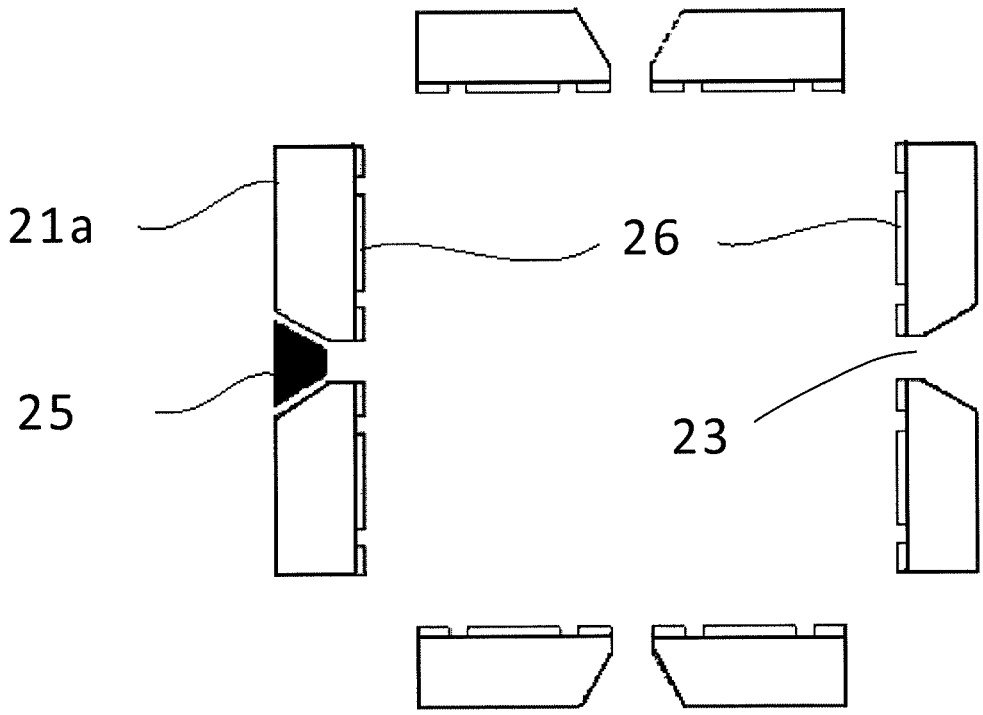
FIG. 4 shows sectional structure of PCB linear ion trap according to the third embodiment.

FIG. 4 shows the sectional structure of PCB linear ion trap according to this embodiment. Printed circuit 26 is set on at least part of the electrode surfaces and field adjusting electrode 25 is set in the middle of X electrode 21 opposite to the outlet slot 23. Wherein, the field adjusting electrode 25 with trapezium section can be placed inside and apart from the adjacent electrode 21*a*. Familiar with the first embodiment, the voltage on the said field adjusting electrode is set equivalent to composition of at least part of high frequency voltage $V_{1a}$ on nearby X electrode 1*a* and a DC voltage VDC, that is:

$$V_{fae}=cV_{1a}+V_{DC}0<c\leq 1$$

Using the said field adjusting electrode 25, harmful effects caused by outlet slot on ion motion can be further overcome, increasing single-side ion ejection efficiency.

There are lots of methods/devices/circuits used to superimpose high frequency voltage and DC voltage applied on different kinds of field adjusting electrodes mentioned above. Two examples are shown as follows.

Figure 5:
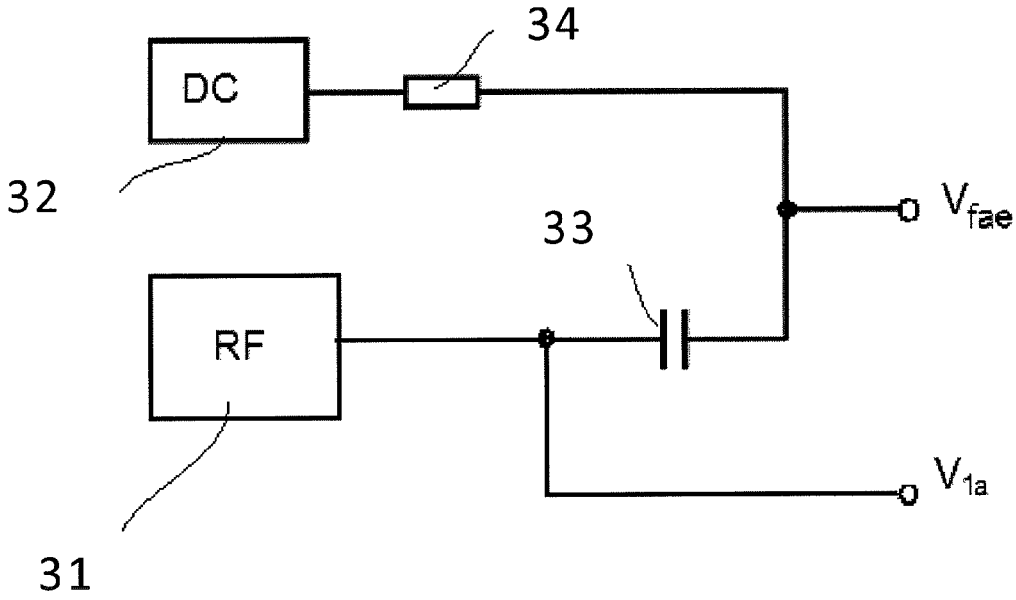
FIG. 5 shows the circuit in principal to superimpose the high frequency voltage component and the field-adjustable DC component according to one embodiment of this invention.

FIG. 5 shows the circuit in principal used to superimpose high frequency voltage component and field-adjustable DC voltage component according to one embodiment of this invention. According to FIG. 5, high frequency electric source output, which connects to separate adjacent columnar electrodes 1*a*, 11*a* through a capacitor 33, connects to separate field adjusting electrodes 5, 15, 25 to provide $V_{DC}$ through a resistor (and/or an inductor). While the said DC voltage source 32 should adjust its voltage value according to specific needs. If RF voltage is scanned, the said voltage $V_{DC}$ should increase as RF voltage increases.

Generally, the ratio of peak values of $V_{DC}$ and $V_{1a}$ should be 0 to 5% if field adjusting electrode is basically even with the adjacent columnar electrode on one side of trapping volume (shown as FIGS. 2 and 3). If the field adjusting electrode is placed inside the slot of the adjacent columnar electrode (shown as FIG. 4) or even after, the ratio should be increased.

The disadvantage of this option is that the resistance must be large enough, generally several mega or several tens of mega ohms Otherwise, the RF power supply will be affected and the RF voltage applied on field adjusting electrode 5, 15, 25 will be insufficient. However, DC voltage component applied on the field adjusting electrode could not be set up or adjusted quickly if the coupled resistance is much too large.

In order to solve this conflict, the option is brought forward in another embodiment of this invention, which superimposes high frequency voltage component of the adjacent columnar electrodes obtained by coupling capacitor and DC voltage component through a diode.

Figure 6:
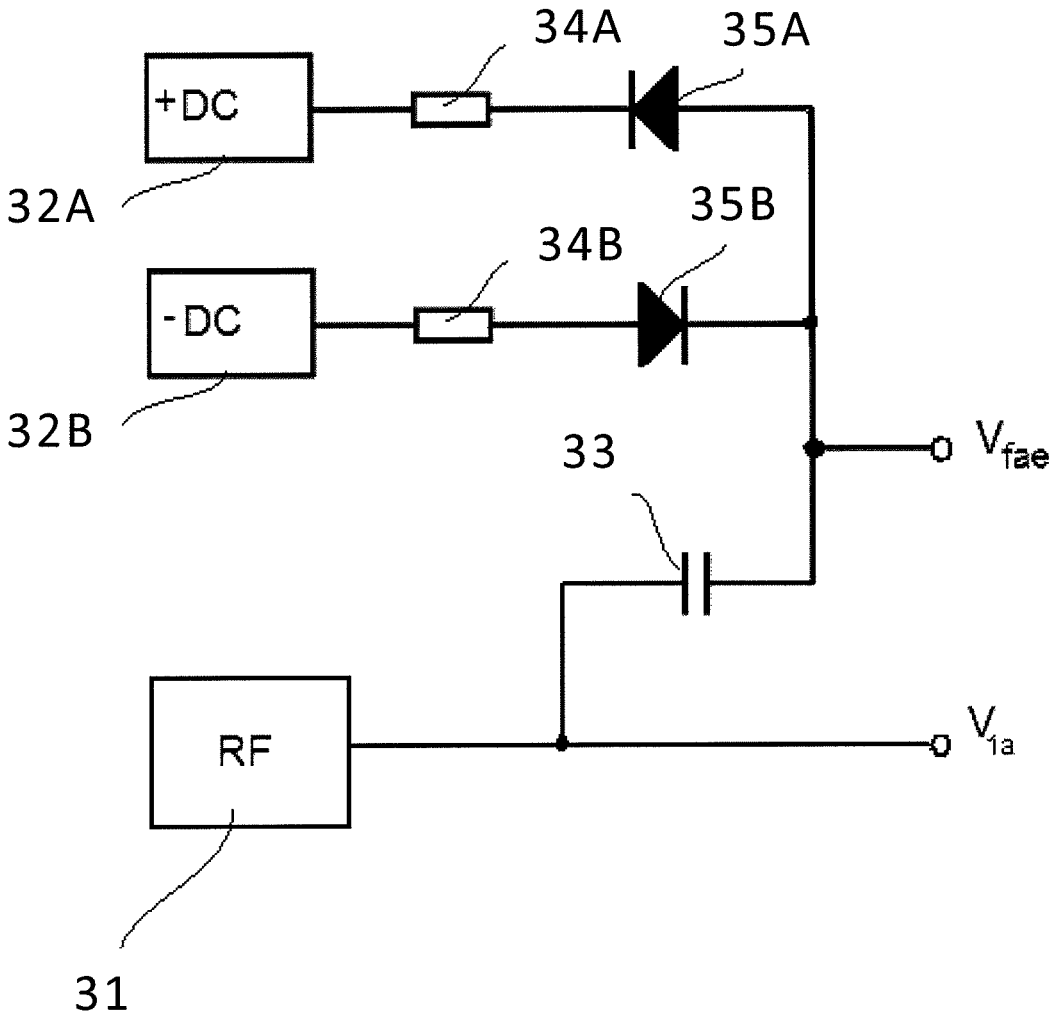
FIG. 6 shows the circuit in principal to superimpose high frequency voltage component and the field-adjustable DC component using capacitors and diodes according to another embodiment of this invention.

According to FIG. 6, high frequency voltage applied on the columnar electrodes is provided by RF power supply 31 and is further applied on field adjusting electrode through capacitor 33. DC negative power supply 32B is connected to field adjusting electrode through resistor 34B and diode 35B. If output voltage $V_1$ of DC negative power supply 32B is higher than the negative peak value $-V_{1a}$ (0–p) of high frequency voltage $V_{1a}$, diode 35B would be conducted for a while on negative half cycle. Capacitor 33 is charged by negative power supply through resistor 34B and diode 35B and the lowest value of output voltage $V_{fae}$ will be increased to the level of $V_1$ after several cycles, which equals to high frequency voltage superposed with a DC component $V_1+V_{1a}$ (0–p). For example, $V_{1a}$ is 1000V RF voltage, $V_{1a}$ (0–p)= 1000V, the output of DC negative power supply 32B is $V_1$=–800V, thus $V_{DC}$=–800+1000=200V. In other words, DC voltage (–800V) provided by DC power supply 32B is equal to the sum of needed DC voltage (+200V) and negative peak value of high frequency voltage (–1000V).

Using this method mentioned above, a DC voltage could be superposed with a high frequency voltage. By changing the value of $V_1$, adjustment of amplitude of DC voltage superimposed will be realized. Resistor 34B of several kilo-ohms to several hundreds of kilo-ohms plays a role of current limit, which would satisfy with the need of DC voltage set-ups on the field adjusting electrode.

When providing positive DC for field adjusting electrode, the output voltage $V_{1A}$ of positive DC supply 32A is higher than $V_{1a}$(0–p)+$V_{DC}$ (that is, $V_1+2V_{1a}$(0–p)), thus diode 35A is reversed and out of work. When providing the needed negative DC component to field adjusting electrode, positive electric supply 32A is connected to the field adjusting electrode through resistor 34A and diode 35A. Diode 35A will be forward for a while if the output $V_{1A}$ of DC power supply 32A is lower than the positive peak value $V_{1a}$(0–p) of high frequency voltage $V_{1a}$. Capacitor 33 will be charged or discharged by power supply 32A through resistor 34A and diode 35A. After several cycles, the maximum peak value of output $V_{fae}$ will be decreased to the level of $V_1$, which equals to a DC level superposition on high frequency voltage $V_{DC}=V_1-V_{1a}$ (0–p). Diode 35B will be reversed and negative power supply is out of work as long as the output $V_1$ of negative power supply 32B is lower than $V_{DC}-V_{1a}$(0–p) (that is, $V_1-2V_{1a}$ (0–p)).

In a word, whether positive or negative DC voltage is superimposed, the DC component supplied by DC power supply is equal to the sum of the DC voltage needed and the peak value of high frequency voltage (positive or negative phase).

Figure 7:
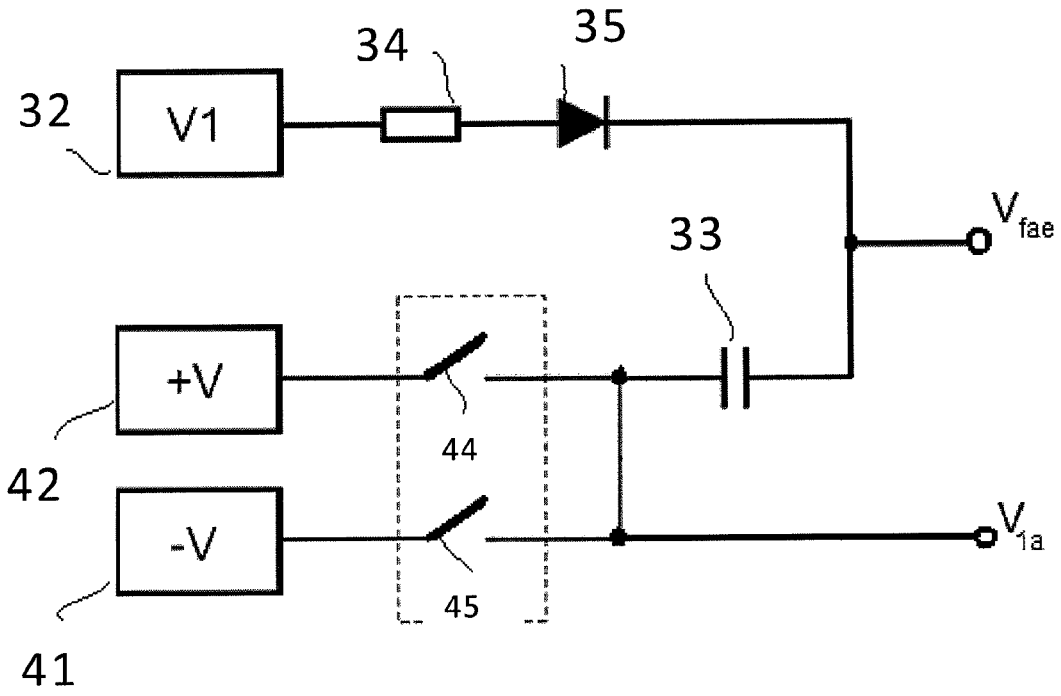
FIG. 7 shows the circuit in principal to superimpose field-adjustable DC component to rectangular switching voltages in digital ion trap according to another embodiment of this invention.

When the driving voltage of ion trap is digital square waveform, the diode coupling option can be described by FIG. 7, wherein the circuit comprises DC power supply 32, resistor 34, diode 35, capacitor 33, high voltage DC power supply 41 and 42 as well as switch 44 and 45.

The output of DC high voltage supply 42 is +V and the out put of DC high voltage supply 41 is –V. The high frequency square waveform is generated by switch 44 and 45. The switch 44 and 45 can be on and off in turn controlled by an outside controller so that square waveform with peak value of V can be generated.

When switch 44 is on and 45 is off, diode 35 is forward and capacitor 33 is charged by DC power supply 32 through resistor 34 and diode 35. The output equals to V1. When switch 44 is off and 45 is on, diode 35 is reversed and the amplitude level of output equals to ((+V) +V1–(–V)).

The method mentioned above can realize to superimpose DC voltage to the high frequency square waveform, wherein the amplitude of the DC voltage superimposed equals to V1–(–V) and the amplitude can be adjusted by changing the value of V1.

The diodes 35 or 35A and 35B used in the circuit mentioned above should have high reverse breakdown voltage, low junction capacity, large positive peak current and quick reverse recovery capability. The diode in the embodiment can be replaced by using serial multiple diodes.

With the help of the field adjusting electrode, field components in the linear ion trap can be adjusted according to the need of real working mode, which can help improve ions motion characteristics obviously during the resonant ejection.

Figure 8:
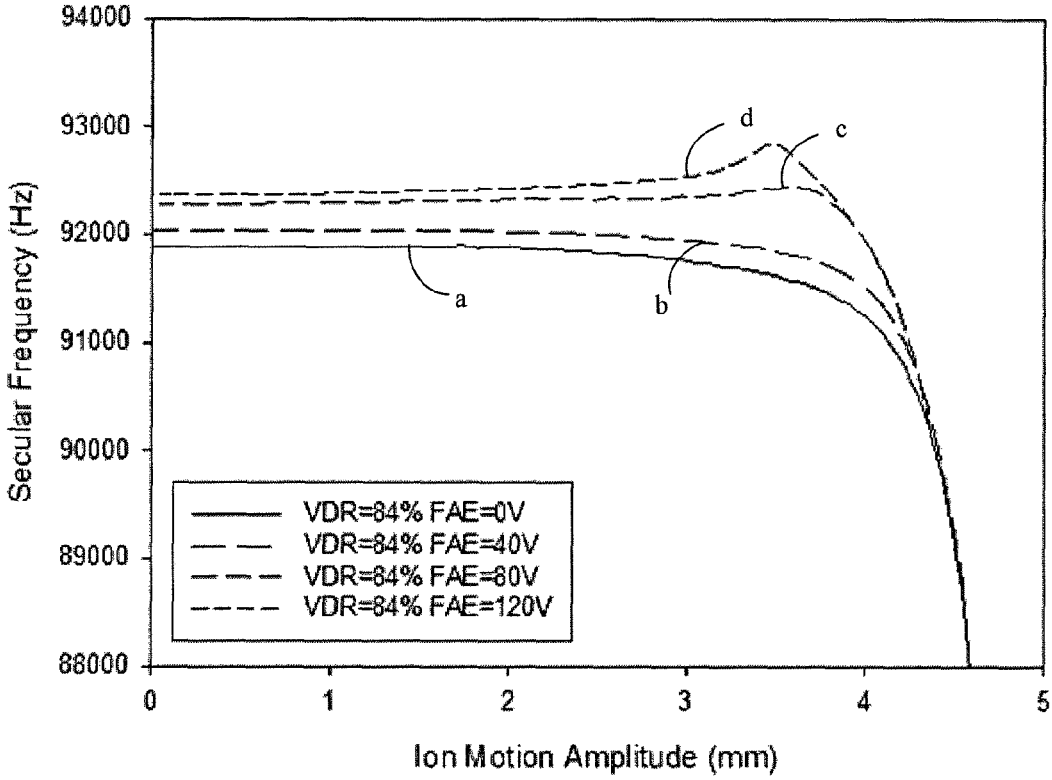
FIG. 8 shows the relationship of ion secular frequency and motion amplitude when field adjusting electrode voltage equals to 0 v, 40 v, 80 v, 120 v, respectively.

FIG. 8 shows the ions secular frequency as function of increasing amplitude of ions motion in PCB linear ion trap shown in FIG. 4, which was obtained by computer simulate, wherein, the solid line a stands for the relationship of ions secular frequency reduction as ions motion amplitude increases when DC voltage on field adjusting electrode equals to zero. If forward scan is used, dipole excitation frequency is larger than ions motion frequency. When ions motion amplitude reaches around 3 mm, the secular frequency will reduce, which would cause ions motion frequency loss from dipole excitation frequency, ejection process delay and spectrum with a very low resolution.

If DC voltage applied on field adjusting electrode is set higher, such as 80 V (dotted line c) shown in the figure, the resonant frequency will increase rather than decrease when ions amplitude reaches around 3 mm. Ions may get fully resonant with the dipole electric field when they move around 3.5 mm under forward scan and they are excited fast and eject from outlet slot, which would cause spectrum with high resolution.

For the DC voltage on field adjusting electrode is adjusted to a higher value (for example a proper one higher than 0V), part of positive ions which may eject from the field-adjusting-electrode side can be reflected back by the said field adjusting electrode and thus more positive ions can eject from the opposite side through the outlet slot on X electrode. In other words, ions prefer to eject from the outlet slot which increase ions single-side ejection efficiency. The said proper DC voltage can be obtained by practical measurement although the value of said DC voltage may be different in specific applications.

On the contrary, since dipole excitation frequency is lower than ions motion frequency, when reverse scan is carried out, lower DC voltage on the field adjusting electrode (for instance, dotted line b in the figure) can help ions eject and obtain higher resolution. With the help of field adjusting electrode, proper voltages can be chosen according to different scan modes and scan speeds so that optimization under proper situation could be realized. Since combination of forward and reverse scans can be used in precursor ions selectivity, precursor spectrum with high resolution can also be realized through DC voltage optimization on field adjusting electrode under proper situation.

Using field adjusting electrode, it could be obtained not only to optimize process of ions scans and ejection as well as mass-selectively isolation, but also to improve effects of excited precursor collision induced dissociation. For example, the DC voltage of 0V or 120V in FIG. 8 is chosen and a lower dipole voltage is used at 92 KHz to excite ions. When the amplitude of precursor ions increases 3 mm, their motion frequency will be apart from dipole excitation frequency of 92 KHz because of their motion frequency loss (solid line a when DC voltage equals to 0V) or gain (dotted line d when DC voltage equals to 120V). Ions would not be further excited, which avoids precursor ions ejection or hitting on electrodes which would cause ions loss. If collision happens between precursor ions and neutral particles, causing precursor ions kinetic loss and amplitude reduction, their frequency will again come close to dipole excitation frequency of 92 KHz, which will excite precursor ions motion amplitude. Thus, the precursor ions will stay at high kinetic state for a long period and avoid being further excited, which would increase possibility of collision induced dissociation.

It is only part of the functions that influence ions motion using field adjusting electrode. In fact, it can be developed by anyone who is familiar with ion trap working principles. Besides, in the embodiment only one field adjusting electrode is placed along the field axis, which could be replaced by multiple field adjusting electrode segments to adjust fringe field components separately. The location of field adjusting electrode can be either in the slit on the electrode opposite to the outlet slot or aperture or between the pair of electrode in ejection direction. The top of electrode can be even with surrounding X electrode, or put deeply inside the slit, only that the electric field generated can infiltrate and influence the field inside the ion trap. The field adjusting electrode is not necessarily completely straight. It could have gurgitations, gradient, being curved to correct field ununiformity along the axial direction of the ion trap. All these changes can be easily achieved by people with skill in the same field using knowledge from this invention, which should be covered by this invention.

What is claimed is:

1. A linear ion trap analyzer, comprising, an ion trapping volume surrounded by multiple columnar electrodes, wherein a generatrix of the multiple columnar electrodes is parallel to a central axis of the ion trapping volume;

a high frequency voltage applied to at least a part of the multiple columnar electrodes to form a trapping electric field in the ion trapping volume;

an ejection slot configured to pass ions resonantly ejected from the ion trapping volume perpendicular to the central axis; and a field adjusting electrode opposite the ejection slot and configured to assist ejection of selected ions from the ion trapping volume, wherein, the field adjusting electrode is placed between two of the multiple columnar electrodes or inside the slot in one of the multiple columnar electrodes, and a potential applied to the field adjusting electrode is set as the sum of a portion of the high frequency voltage applied to an adjacent columnar electrode and an adjustable DC voltage offset.

2. The linear ion trap analyzer according to claim 1, further comprising an electric circuit for applying the potential to the field adjusting electrode, the electric circuit comprising:

a capacitor for coupling the portion of the high frequency voltage to the field adjusting electrode, and a resistor, an inductor, or both a resistor and inductor for applying the DC voltage offset on the portion of the high frequency voltage; and a controllable DC voltage source coupled to the resistor, an inductor, or both a resistor and inductor.

3. The linear ion trap analyzer according to claim 1, further comprising an electric circuit for applying the potential to the field adjusting electrode, the electric circuit comprising:

a capacitor for coupling the portion of the high frequency voltage to the field adjusting electrode, and a diode for applying the DC voltage offset on the portion of the high frequency voltage, wherein, the DC voltage offset is controlled by a DC voltage power supply and a DC amplitude of the DC voltage offset substantially equals the sum of a DC voltage offset of the field adjusting electrode and a positive or a negative peak value of the high frequency voltage.

4. The linear ion trap analyzer according to claim 1, wherein each of the multiple columnar electrodes comprises a hyperbolic columnar surface.

5. The linear ion trap analyzer according to claim 1, wherein each of the multiple columnar electrodes is comprises a planar columnar surface.

6. The linear ion trap analyzer according to claim 1, wherein each of the multiple columnar electrodes comprises a step-shaped columnar surface.

7. The linear ion trap analyzer according to claim 1, wherein each of the multiple columnar electrodes comprises planar patterns of printed circuits.

8. The linear ion trap analyzer according to claim 1, wherein the field adjusting electrode is segmented.

9. The linear ion trap analyzer according to claim 1, wherein the high frequency voltage is generated by digital switches and is characterized by a rectangular waveform.

10. The linear ion trap analyzer according to claim 1, wherein a strength or a frequency of the trapping electric field is scanned while the AC electric field superposition is applied to invoke dipole excitation in the direction perpendicular to the said axis and to invoke the ions trapped inside the linear ion trap to eject resonantly according to their mass-to-charge ratios; and further comprising a control for altering the DC voltage offset applied to the field adjusting electrode when the said scan is reversed or the scan speed is changed.

11. The linear ion trap analyzer according to claim 1, wherein the DC voltage offset applied to the field adjusting electrode is configured to resonantly eject ions through the ejection slot and is varied according to a mass-to-charge ratio of ions ejected during a mass scan.

12. The linear ion trap analyzer according to claim 1, wherein the DC offset voltage applied to the field adjusting electrode is set to generate a high order DC field when the AC electric field is applied to invoke dipole excitation of at least one ion, wherein the high order DC field alters the secular frequency of the at least one ion from the frequency of the AC electric field when an amplitude of ion motion is close to a field radius of the linear ion trap, such that the ion avoids being further excited.

13. The linear ion trap analyzer according to claim 1, wherein the ejection slot and the field adjusting electrode are disposed between two columnar electrodes.

14. The linear ion trap analyzer according to claim 1, wherein the ejection slot is in a columnar electrode; and the field adjusting electrode is set inside a slot in a columnar electrode opposite the ejection slot.

15. The linear ion trap analyzer according to claim 1, wherein the ejection slot is in the middle of a columnar electrode; and the field adjusting electrode is set inside a slot in the middle of a columnar electrode opposite the ejection slot.

16. The linear ion trap analyzer according to claim 1, wherein the field adjusting electrode is elongated.

17. The linear trap analyzer according to claim 1, wherein the portion of the high frequency voltage is characterized by a the same phase and a reduced amplitude compared to a phase and amplitude of the high frequency voltage applied to the adjacent columnar electrode.

* * * * *